US008616546B2

(12) United States Patent
Kunioka

(10) Patent No.: US 8,616,546 B2
(45) Date of Patent: Dec. 31, 2013

(54) SHEET FEEDER AND IMAGE FORMING APPARATUS HAVING STACKER WITH ELEVATION UNIT

(75) Inventor: Satoshi Kunioka, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 134 days.

(21) Appl. No.: 12/910,380

(22) Filed: Oct. 22, 2010

(65) Prior Publication Data

US 2011/0109037 A1 May 12, 2011

(30) Foreign Application Priority Data

Nov. 9, 2009 (JP) ..... 2009-256219

(51) Int. Cl.
*B65H 1/08* (2006.01)

(52) U.S. Cl.
USPC ..... 271/126; 271/127; 271/171

(58) Field of Classification Search
USPC ..... 271/161, 171, 10.12, 127, 117, 118, 271/126, 145, 147, 148, 167, 169, 170; 347/104
See application file for complete search history.

(56) References Cited

U.S. PATENT DOCUMENTS

| | | | | |
|---|---|---|---|---|
| 4,579,328 | A * | 4/1986 | Hagihara et al. | 271/9.08 |
| 4,828,245 | A * | 5/1989 | Shimogawara | 271/171 |
| 5,537,195 | A * | 7/1996 | Sagara et al. | 399/381 |
| 5,887,867 | A | 3/1999 | Takahashi et al. | |
| 6,315,280 | B1 * | 11/2001 | Jang | 271/9.02 |
| 7,270,323 | B2 * | 9/2007 | Somemiya | 271/127 |
| 7,770,888 | B2 * | 8/2010 | Nakamura | 271/171 |
| 7,887,038 | B2 * | 2/2011 | Shigeno et al. | 271/9.08 |
| 7,922,171 | B2 * | 4/2011 | Kawamura et al. | 271/171 |
| 2007/0086819 | A1 * | 4/2007 | Park | 399/393 |
| 2008/0179820 | A1 * | 7/2008 | Kawamura et al. | 271/147 |
| 2009/0041525 | A1 | 2/2009 | Kunioka | |
| 2011/0187047 | A1 * | 8/2011 | Ichikawa et al. | 271/127 |

FOREIGN PATENT DOCUMENTS

| | | | | |
|---|---|---|---|---|
| CN | 101236376 | | 8/2008 | |
| JP | 63-12547 | | 1/1988 | |
| JP | 2-178140 | | 7/1990 | |
| JP | 06144598 | A * | 5/1994 | B65H 1/26 |
| JP | 9-315595 | | 12/1997 | |
| JP | 2000-313530 | | 11/2000 | |
| JP | 2001-139156 | | 5/2001 | |

(Continued)

OTHER PUBLICATIONS

Chinese official action dated May 21, 2013 in corresponding Chinese patent application No. 2010 10 55 0405.4.

(Continued)

*Primary Examiner* — Jeremy R Severson
(74) *Attorney, Agent, or Firm* — Cooper & Dunham LLP

(57) ABSTRACT

A sheet feeder includes a stacker that accommodates multiple sheets of recording media, an elevation unit disposed in a downstream portion of the stacker in a sheet feeding direction and which ascends to lift a leading edge portion of the sheet in the sheet feeding direction, a rotary feeding member disposed facing the elevating unit and forming a nip in which the leading edge portion of the sheet is clamped together with the elevation unit when the elevation unit ascends, and a guide unit disposed adjacent to an outer circumference of the feeding member, facing an upper side of the leading edge portion of the sheet. The guide unit guides the leading edge portion of the sheet toward the nip between the feeding member and the elevation unit.

18 Claims, 9 Drawing Sheets

(56) References Cited

FOREIGN PATENT DOCUMENTS

| | | |
|---|---|---|
| JP | 3521039 | 2/2004 |
| JP | 3731849 | 10/2005 |
| JP | 2006-21865 | 1/2006 |

OTHER PUBLICATIONS

Japanese official action dated Sep. 3, 2013 in corresponding Japanese patent application No. 2009-256219.

* cited by examiner

SHEET FEEDER AND IMAGE FORMING APPARATUS HAVING STACKER WITH ELEVATION UNIT

CROSS-REFERENCE TO RELATED APPLICATIONS

This patent specification is based on and claims priority from Japanese Patent Application No. 2009-256219, filed on Nov. 9, 2009 in the Japan Patent Office, which is hereby incorporated by reference herein in its entirety.

BACKGROUND OF THE INVENTION

1. Field of the Invention

The present invention generally relates to a sheet feeder and an image forming apparatus such as a copier, a printer, a facsimile machine, or a multifunction machine capable of at least two of these functions.

2. Description of the Background Art

Generally, there are two types of image forming apparatuses such as printers, facsimile machines, copies, or multifunction machines including at least two of these functions: ink-ejecting image forming apparatus using a recording head or liquid ejection head that ejects ink droplets onto sheets of recording media, and electrophotographic image forming apparatuses that develop electrostatic latent images with developer.

Ink-ejecting image forming apparatuses form images by ejecting ink droplets onto the sheet with the recording head while transporting the sheet. In such ink-ejecting image forming apparatuses, it is important to keep the ink in the recording head at a given negative pressure, that is, to keep the pressure exerted on the ink in the recording head at a given negative pressure, in order to eject ink reliably from the recording head. Therefore, ink-ejecting image forming apparatuses typically include a negative pressure generation unit disposed in an ink supply system for supplying ink to the recording head under negative pressure.

By contrast, electrophotographic image forming apparatuses form images by performing a series of interrelated processes, from electrical charging to image exposure, development, and transfer, on a photoconductor serving as a latent image carrier. More specifically, electrostatic latent images are formed on the latent image carrier and developed by a development unit into toner images. Then, the toner images are transferred onto sheets of recording media.

In both types of apparatuses, output images are formed on sheets fed to an image forming position or an image-transfer position from a sheet cassette or a manual feed tray provided separately from the sheet cassette.

Sheet cassettes generally include a feeding mechanism for picking up and conveying multiple sheets stacked therein one sheet at a time. For example, the feeding mechanism includes a feeding roller for conveying the sheet and a stack plate provided inside the sheet cassette that guides the leading edge portion of the sheet toward a feeding roller. The sheet is picked up and conveyed by the rotational force of the feeding roller when the sheet on the top of the multiple sheets stacked on the stack plate contacts the feeding roller.

Herein, it is possible that the sheets stacked on the stack plate curl. Sheets tend to curl when the rate of expansion and shrinkage of sheet fibers becomes uneven in the sheet, due to changes in temperature or humidity or after a first side of the sheet is heated in an image-fixing process in duplex printing. In addition to curling in a sheet width direction perpendicular to a longitudinal direction of the sheets, sheets can curl in the longitudinal direction when placed with the direction of fibers called a Y grain or long grain, which parallels the longitudinal direction of the sheet, in a direction in which the sheet is transported (hereinafter "sheet conveyance direction or sheet feeding direction"). In such a case, the sheet curls upward or downward in the sheet conveyance direction.

Regarding sheet feeding methods, for example, JP-3521039-B proposes a method in which the sheet cassette is provided horizontally and the stack plate inside the sheet cassette is lifted to bring the sheet into contact with the feeding roller. Alternatively, JP-3731849-B proposes a method in which the sheet cassette is angled with respect to the body of the image forming apparatus and the sheets stacked on the stack plate are forwarded to the feeding roller under the force of gravity (hereinafter "oblique feeding method").

In either method, in order to separate a single sheet from the multiple sheets stacked on the stack plate, a frictional pad is provided obliquely to guide the leading edge portion of the sheet upward. In such a configuration, when multiple sheets are forwarded to the feeding roller at the same time, only the sheet on the top, which is in contact with the feeding roller, can be allowed to be separated from the other sheets by varying the frictional force between the multiple sheets, on the one hand, and the frictional force between the frictional pad and the sheet in contact with the frictional pad on the other. However, if the sheet curls, the sheet cannot be forwarded properly to the position where the frictional pad separates the sheet on the top from the multiple sheets.

Therefore, the above-described first approach proposes providing curved regulation members on the tops of side fences of the cassette to correct the curl of the sheet in the sheet width direction, and the above-described second approach proposes providing a roller or a rib that can press the upper surface of the sheet. The first approach is for correcting curl in the sheet width direction with both end portions in the sheet width direction curling upward, and the second approach is for correcting curl in the sheet conveyance direction with both end portions and a center portion in the sheet conveyance direction curling downward and bulging, respectively.

However, the leading edge portion of the sheet in the sheet conveyance direction can curl upward as well as downward. In such a case, the leading edge portion of the sheet is likely to contact the circumferential surface of the feeding roller. If such upward curl occurs in the configuration described above in which the leading edge portion of the sheet is lifted and is fed to the separation position by the feeding roller clamping the sheet together with an elevation member lifting the sheet, it is possible that the sheet cannot be fed properly, resulting in feeding failure or separation failure.

The above-described first and second approaches do not address feeding of sheets having upward curls in the sheet conveyance direction.

Sheets without upward curls can be guided relatively easily to the position where the sheet is sandwiched (hereinafter "sandwiched position") because the direction in which the sheet is transported toward the sandwiched position is identical or similar to the direction in which the sheet passes the sandwiched position. However, for example, in a configuration in which the feeding roller rotates counterclockwise, and the clamped position is on a lower side of the circumference of the feeding roller, if the leading edge portion of the sheet in the sheet conveyance direction curls upward, which is opposite the direction in which the feeding roller rotates, it is difficult to guide the sheet to the clamped position using rotation of the feeding roller alone.

Such a problem may be solved by preliminarily causing the leading edge portion of the top sheet on the stack plate to contact the feeding roller in order to press the curling edge portion of the sheet with the circumferential surface of the feeding roller. However, in this method, for example, it is necessary to keep the leading edge portion of the stack plate lifted because the leading edge portion of the sheet must be kept lifted to be in contact with the feeding roller. As a result, the quantity of sheets stacked on the stack plate is reduced compared with a configuration in which the stack plate can be lowered, and accordingly frequency of replenishment of sheets increases.

In view of the foregoing, the inventor of the present invention recognizes that there is a need for a sheet feeder capable of feeding curling sheets properly and an image forming apparatus including the sheet feeder, which known approaches fail to do.

SUMMARY OF THE INVENTION

In view of the foregoing, in one illustrative embodiment of the present invention, a sheet feeder includes a stacker for accommodating multiple sheets of recording media, an elevation unit disposed in a downstream portion of the stacker in a sheet feeding direction in which the sheet is transported from the stacker and which ascends to lift a leading edge portion of the sheet in the sheet feeding direction, a rotary feeding member disposed facing the elevating unit and forming a nip in which the leading edge portion of the sheet is clamped together with the elevation unit when the elevation unit ascends, and a guide unit disposed adjacent to an outer circumference of the feeding member, facing an upper side of the leading edge portion of the sheet. The guide unit guides the leading edge portion of the sheet toward the nip between the feeding member and the elevation unit.

In another illustrative embodiment of the present invention, an image forming apparatus includes an image forming unit to form an image on a sheet of recording media, and the sheet feeder described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
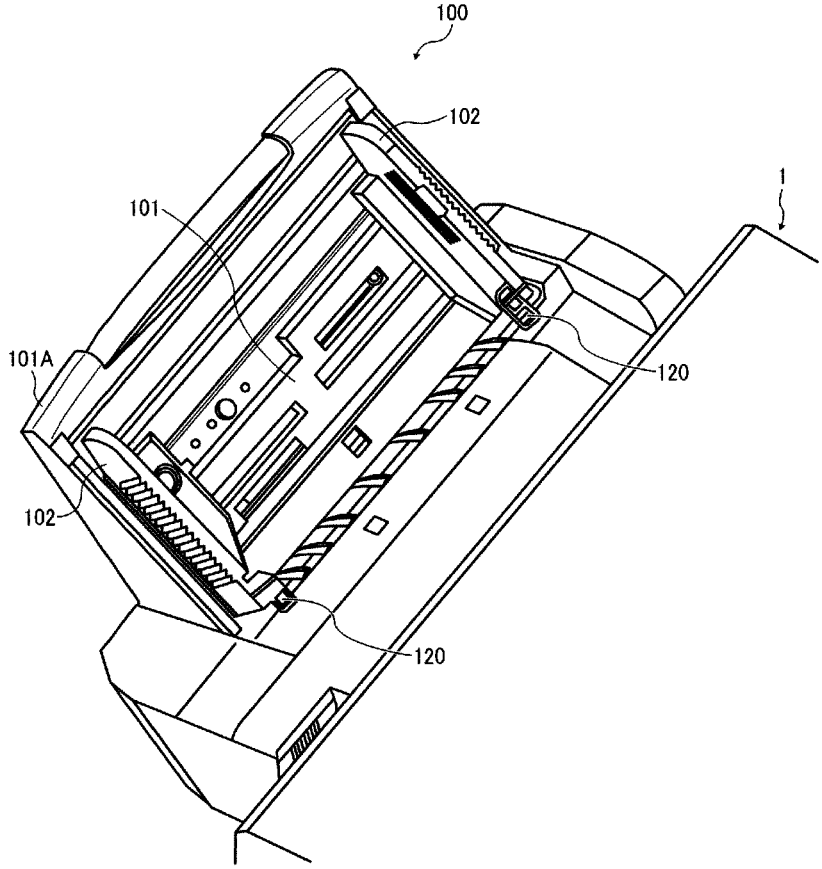
FIG. 1 is a perspective view that schematically illustrates an exterior of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be noted that, in the present specification, the term "recording media" includes not only paper but also thread, fiber, textile, leather, metal, plastic, glass, wood, ceramic, and the like, which ink can adhere to or permeate.

Referring now to the drawings, wherein like reference numerals designate identical or corresponding parts throughout the several views thereof, and particularly to FIG. 1, an image forming apparatus according to an illustrative embodiment of the present invention is described.

FIG. 1 illustrates an image forming apparatus that in the present embodiment is an ink-ejecting printer capable of forming images by ejecting ink droplets onto recording sheets at positions according to image data, and a sheet feeder 100 is attached to an apparatus body 1 of the image forming apparatus. In the present embodiment, the sheet feeder 100 is provided separately from a feeding unit provided inside the apparatus body 1 and includes an inclined stack member 101 on which the recording sheets are stacked so that leading edge portions of the recording sheets can be guided obliquely to a feeding position under the force of gravity. Thus, the sheet feeder 100 adopts an oblique feeding method. It is to be noted that the present embodiment can adapt not only to ink-ejecting image forming apparatuses but also to electrophotographic image forming apparatuses. It is to be noted that, in FIG. 1, reference numeral 101A represents a sheet cassette that includes the stack member 101 on which the recording sheets are stacked, and reference numeral 102 represents side fences each of which is provided with a guide member 120 for guiding the recording sheets.

Mechanism of the ink-ejecting printer is described below with reference to FIGS. 2 and 3, which are respectively cross-sectional view illustrating an interior of the ink-ejecting printer and a plan view illustrating a main part of the ink-ejecting printer.

Figure 2:
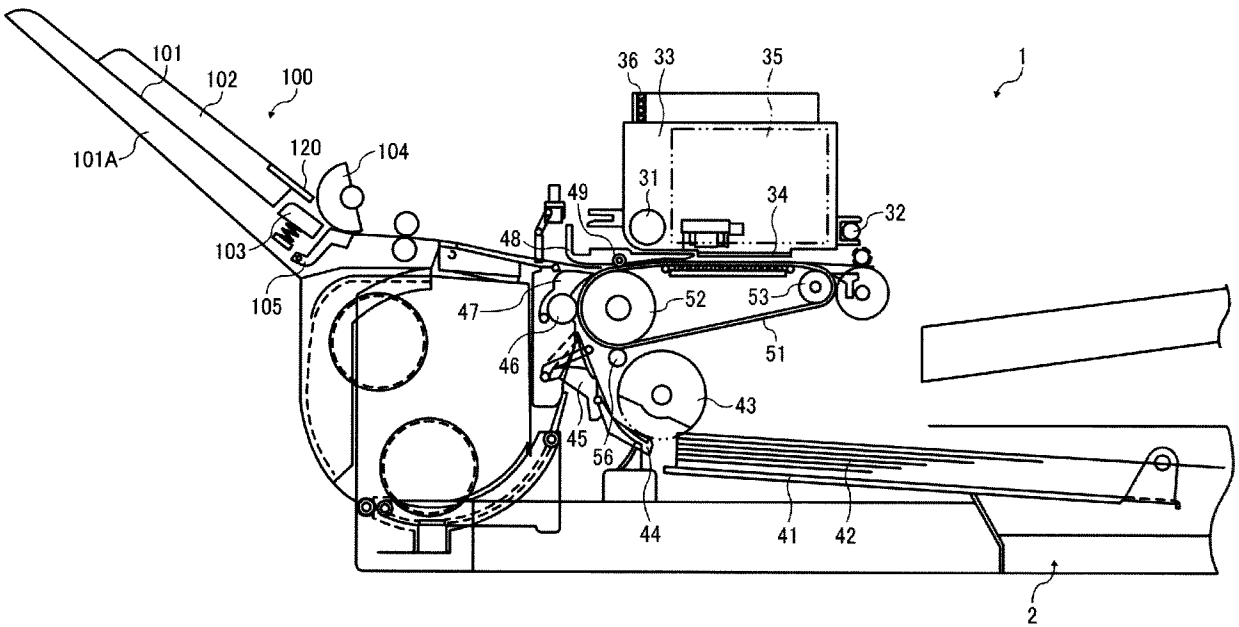
FIG. 2 schematically illustrates an interior of the image forming apparatus shown in FIG. 1.
Figure 3:
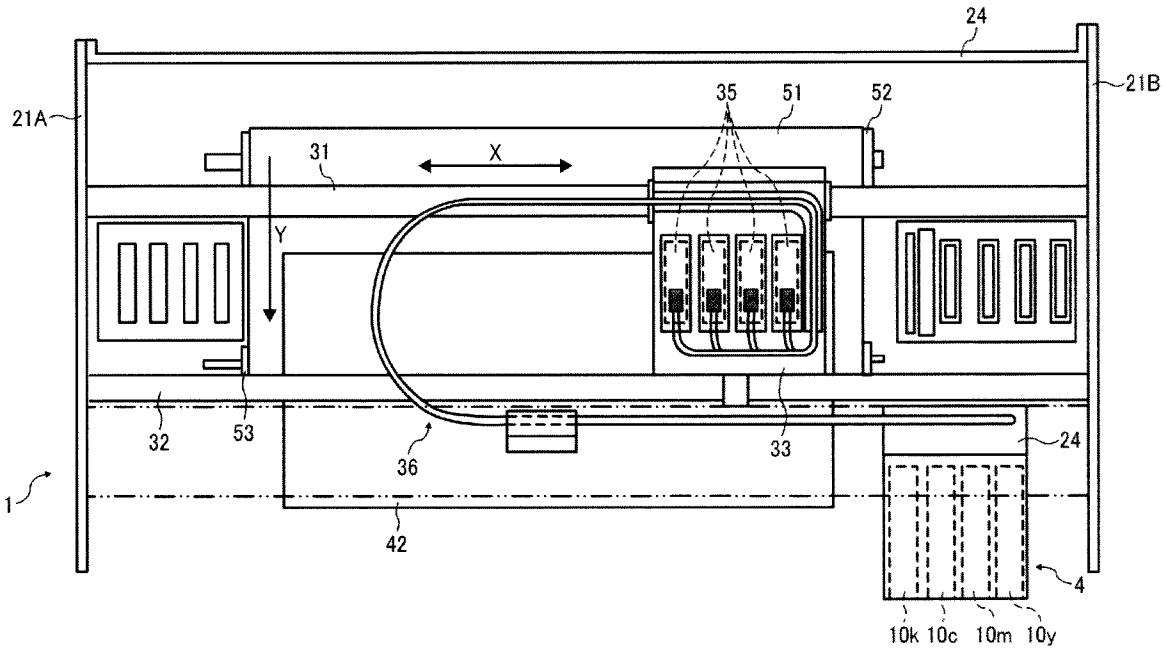
FIG. 3 is a plan view illustrating a main part of the interior of the image forming apparatus shown in FIG. 2.

Referring to FIGS. 2 and 3, the ink-ejecting printer includes right and left side plates 21A and 21B and a carriage 33 supported slidably, in a main scanning direction indicated by arrow X, and a main rod 31 and a sub guide rod 32 that lay across the side plates 21A and 21B for supporting the carriage 33. The carriage 33 travels in the main scanning direction via a timing belt (not shown), driven by a main scanning motor (not shown).

The carriage 33 includes recording heads or droplet ejection heads 34. The recording heads 34 are attached to the carriage 33 so as to eject ink droplets downward. Each recording head 34 includes lines of nozzles arranged in a sub-scanning direction indicated by arrow Y, perpendicular to the main scanning direction.

In FIG. 2, two recording heads 34 are attached to the carriage 33, and each recording head 34 includes two lines of nozzles capable of ejecting different color ink droplets. For example, one of the two recording heads 34 includes a line of nozzles for black (K) ink droplets and that for cyan (C) ink droplets, and the other recording head 34 includes a line of nozzles for magenta (M) ink droplets and that for yellow (Y) ink droplets. Alternatively, ink droplets of an identical color may be ejected from the two lines of nozzles in each recording head 34.

The recording heads 34 include pressure generation devices for ejecting ink droplets, and examples of the pressure generation devices include piezoelectric actuators such as piezoelectric devices, thermal actuators, shape-memory alloy actuators, and electrostatic actuators using electrostatic force. Thermal actuators use changes in phase caused by film boiling of liquid by using thermoelectric conversion elements such as resistive elements that generate heat, and shape-memory alloy actuators use changes in metal phase caused by changes in temperature.

The carriage 33 further includes head tanks 35 that are liquid containers for supplying respective color inks to the recording heads 34 and correspond to the multiple nozzles thereof The respective color inks are supplied to the respective head tanks 35 through supply tubes 36 from respective ink cartridges 10*k*, 10*c*, 10*m*, and 10*y* installed in a cartridge mount 4 shown in FIG. 3. Additionally, a pump unit 24 is provided in the cartridge mount 4 for conveying the respective color inks from the ink cartridges 10*k*, 10*c*, 10*m*, and 10*y*.

Referring to FIG. 2, the ink-ejecting printer further includes a sheet feed tray 2 including a sheet stack part or pressure plate 41 on which recording sheets 42 (recording media) are stacked, a semilunar feeding roller 43 to feed the recording sheets 42, and a separation pad 44 disposed facing the semilunar roller 43. The separation pad 44 includes a material whose frictional coefficient is relatively large and is biased toward the feeding roller 43 so that the sheets 42 are fed one sheet at a time. These components together form the feeding unit provided inside the apparatus body 1.

The recording sheet 42 is then guided to a transport belt 51 by a guide 45, a counter roller 46, a transport guide 47, and a pressure member 48 provided with an edge pressure roller 49. The transport belt 51 electrostatically absorbs the recording sheet 42 and transports the recording sheet 42 to a position facing the recording heads 34.

The transport belt 51 is an endless belt winding around a transport roller 52 and a tension roller 53 rotatably in a belt conveyance direction, that is, the sub-scanning direction indicated by arrow Y shown in FIG. 3. The ink-ejecting printer further includes a charge roller 56 for charging an outer surface of the transport belt 51, that is disposed in contact with the transport belt 51 and rotates as the transport belt 51 rotates. The transport belt 51 rotates in the belt conveyance direction as the transport roller 52 rotates, driven via a timing belt by a sub-scanning motor, not shown.

Figure 4:
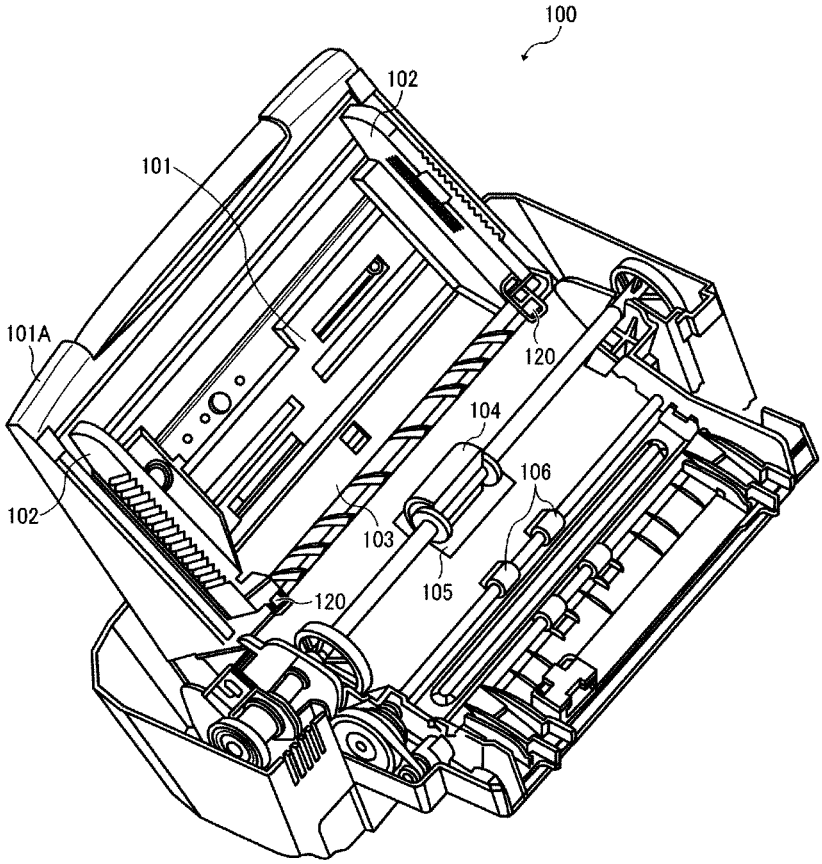
FIG. 4 is a perspective view illustrating an appearance of a sheet feeder.

Additionally, the ink-ejecting printer according to the present embodiment includes the sheet feeder 100 used as a manual feeding unit, provided separately from the feeding unit including the sheet feed tray 2 as described above. The sheet feeder 100 is described in further detail below with reference to FIGS. 2, 4, and 5. FIG. 4 is a perspective view illustrating an appearance of the sheet feeder 100, and FIG. 5 is a cross-sectional view illustrating a side of the sheet feeder 100.

Although not shown in detail, the sheet feeder 100 can be attached to a mounting portion provided in the apparatus body 1 either before or after shipment.

Figure 5:
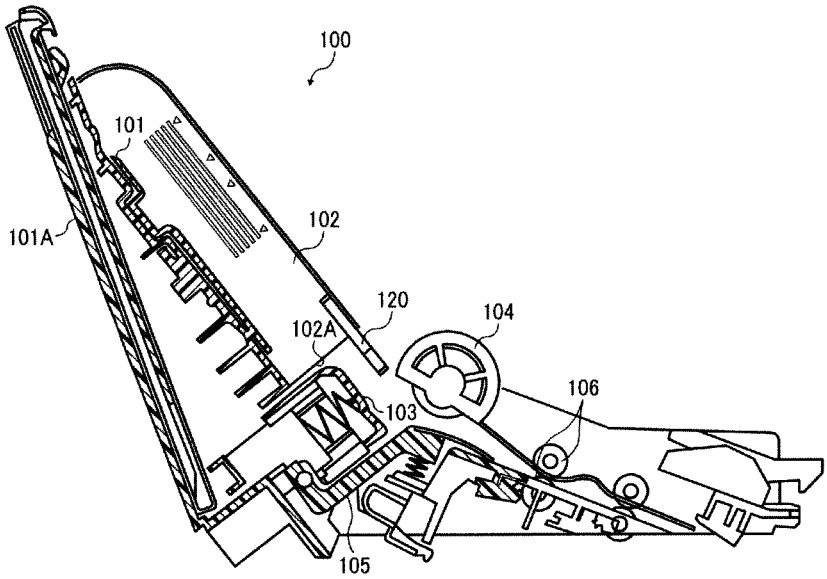
FIG. 5 is a cross-sectional view illustrating a side of the sheet feeder.

As shown in FIGS. 2 and 5, the sheet feeder 100 includes the sheet cassette 101A that includes the stack member 101 on which the recording sheets 42 are stacked and the side fences 102 that include bent edges on both sides in a sheet width direction perpendicular to the direction in which the recording sheets 42 are fed. The sheet feeder 100 further includes an elevation unit 103 for lifting the leading edge portion of the recording sheet 42 in a direction in which the recording sheets 42 are fed to the apparatus body 1 (hereinafter "sheet feeding direction), a feeding member 104 such as a pickup roller (hereinafter "pickup roller 104"), and a separation pad 105 constituted of a frictional member. The elevation unit 103 is disposed close to the stack member 101, and the stack member 101 and the elevation unit 103 together form a stacker on which multiple sheets can be stacked. The elevation unit 103 is disposed in a downstream portion of the stacker in the sheet feeding direction. The pickup roller 104, serving as a separation member, and the separation pad 105 together form a feeding unit for feeding the recording sheets 42 stacked on the stack member 101. It is to be noted that reference numeral 106 in FIG. 4 represents a transport roller that transports the recording sheet 42 separated by the separation member (i.e., pickup roller 104) from the multiple recording sheets 42 stacked on the stack member 101, and reference character 102A in FIG. 5 represents front edges of the side fences 102 in the sheet feeding direction.

A specific feature of the sheet feeder 100 according to the present embodiment is described below.

In the present embodiment, the elevation unit 103 lifts the leading edge portion of the recording sheet 42 in the sheet feeding direction and then the recording sheet 42 is transported to a position where the leading edge portion of the recording sheet 42 is clamped by the pickup roller 104 (feeding roller) and the elevation unit 103 (hereinafter "clamped position"). At that time, the leading edge portion of the recording sheet 42 lifted by the elevation unit 103 can be guided reliably to the clamped position even though curling upward, which is a specific feature of the present embodiment.

More specifically, the guide members 120 are provided at least in an adjacent area of an outer circumference of the backup roller 103 to receive the leading edge portion of the recording sheet 42 curling upward and to guide it to the clamped position.

In the configuration shown in FIGS. 1, 4, and 5, the guide members 120 are provided on the side fences 102 provided in the adjacent area of the outer circumference of the pickup roller 104 and on both sides in an axial direction of the pickup roller 104.

The guide members 120 are positioned facing an upper surface of the leading edge portion of the recording sheet 42 in the sheet feeding direction, lifted by the elevation unit 103. In other words, each guide member 120 is positioned in an upper portion of the leading edge portion of the side fence 102 in the sheet feeding direction.

Differently from pawl members, called corner separators, that are provide at similar positions of the side fences 102 for separating a single recording sheet 42 from the multiple recording sheets 42 stacked on the stack member 101, the leading edge portions of the guide members 120 extend downstream in the sheet feeding direction, thus projecting from the leading edges 102A of the side fences 102.

Figure 6A:
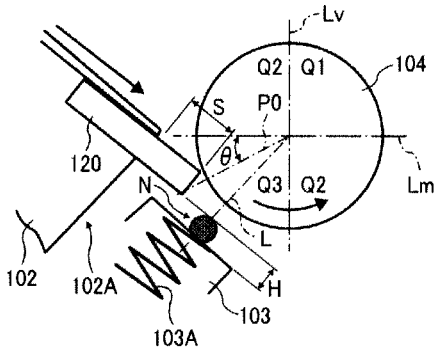
FIGS. 6A through 6C are schematic views that illustrate a theory of the configuration of guide members included in the sheet feeder.
Figure 6B:
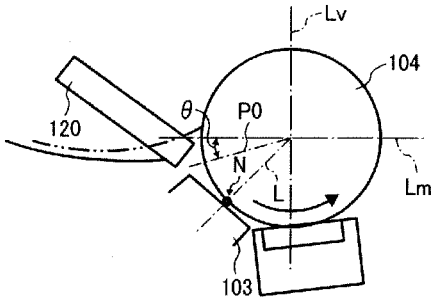
Figure 6C:
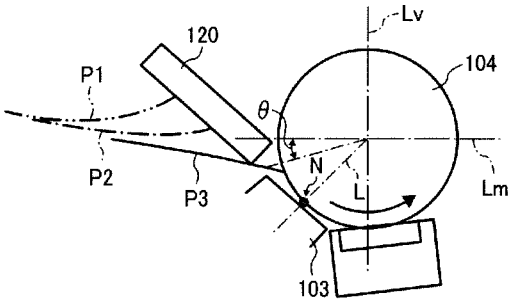

FIGS. 6A through 6C are schematic views that illustrate a theory of the configuration of the guide members 120. In FIGS. 6A and 6C, the leading edges of the guide members 120 are positioned close to the circumference of the pickup roller 104, projecting forward from the leading edges 102A of the side fences 102, which are inclined in the sheet feeding direction for the oblique feeding method. Accordingly, the lower surfaces of the guide members 120 are inclined in that direction. In FIG. 6A, reference character 103A represents a spring included in the elevation unit 103.

It is to be noted that reference characters N represents a nip position, that is, the clamped position where the pickup roller 104 and the elevation unit 103 face each other and transport the recording sheet 42 clamped therebetween, L represents a normal line of the pickup roller 104, and Lm represents a horizontal line passing through a center of rotation of the pickup roller 104. When it is assumed that the nip position N is positioned on the normal line L of the pickup roller 104, the leading edge position of the guide members 120 is positioned upstream from the nip position N in the rotational direction of the pickup roller 104 and is shifted toward the nip N from the horizontal line Lm.

In other words, when reference characters Q1, Q2, Q3, and Q4 shown in FIG. 6A represent a first quadrant (upper right), a second quadrant (lower right), a third quadrant (lower left), and a fourth quadrant (upper left), respectively, in a coordinate plane centered on the center of rotation of the pickup roller 104, the leading edge of the guide members 120 is on a line P0, shifted by an angle θ from the horizontal line Lm to a vertical line Lv in the third quadrant Q3 in the rotational direction of the pickup roller 104. Additionally, in FIG. 6A, the leading edge of the guide members 120 projects by a length S from the leading edge 102A of the side fences 102.

Moreover, a gap H, shown in FIG. 6A, between an upper surface of the elevation unit 103 and a lower surface of the leading edge portion of the guide member 102 has such a size that only a single recording sheet can pass through the gap H smoothly. That is, the gap H is greater than the sheet thickness so that the contact resistance does not hinder passage of the recording sheet.

Providing the guide members 120 with the leading edge position thereof positioned as described above can attain the following effects.

Figure 7:
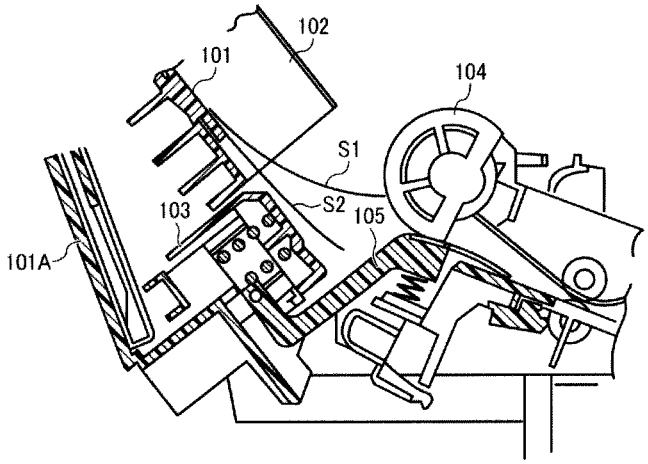
FIG. 7 is a schematic view illustrating a main part of the sheet feeder for picking up and conveying the recording sheet and corresponds to the state shown in FIG. 6B.

In FIG. 6B, broken lines represent a recording sheet that has a leading edge portion curling upward and is fed by a sheet feeder without the guide members 120. In such a case, when the curling leading edge portion of the recording sheet contacts an outer circumferential surface of the pickup roller 104 at a position above the horizontal line Lm passing through the center of rotation of the pickup roller 104, the direction of curl of the leading edge portion of the recording sheet is opposite the rotational direction of the pickup roller 104 as shown in FIG. 6B. As a result, the component of force in the rotational direction of the pickup roller 104, available by the angle by which the leading edge portion of the recording sheet warps, is significantly small, and thus it is difficult to guide the leading edge portion of the recording sheet to the clamped position. FIG. 7 is a schematic view illustrating a main part of the sheet feeder 100 for picking up and conveying the recording sheet and corresponds to the state shown in FIG. 6B. In FIG. 7, reference characters S1 and S2 represent recording sheets having a leading edge portion curling upward and that having a leading edge portion whose degree of curl is smaller, respectively.

By contrast, a solid line shown in FIG. 6B represents a recording sheet that has a leading edge portion curling upward and is fed by the sheet feeder 100 with the guide members 120 according to the present embodiment. In this case, the leading edge portion of the recording sheet contacts the guide members 120 and then moves toward the leading edge of the guide members 120 under the force of gravity.

With the leading edge position of the guide members 120 positioned as described above, the leading edge portion of the recording sheet that projects from the leading edges 102A (shown in FIG. 6A) is likely to contact the circumferential surface of the pickup roller 104 at a position beneath the horizontal line Lm passing through the center of rotation of the pickup roller 104. That is, the guide members 120 direct the leading edge portion of the recording sheet downstream in the rotational direction of the pickup roller 104.

In this state, the leading edge portion of the recording sheet is likely to be drawn in the direction opposite the direction of the upward curl due to rotational force of the pickup roller 104, which facilitates reliable guiding of the recording sheet to the nip position N. In other words, the leading edge portion of the recording sheet conform the rotational direction of the pickup roller 104 more easily and can move toward the nip position N more reliably as the pickup roller 104 rotates.

FIG. 6C illustrates movement of the recording sheet whose leading edge portion curls upward in the sheet feeder 100 with the guide members 120. The leading edge portion of the recording sheet curling upward in the sheet feeding direction contacts the guide members 120 as indicated by broken lines P1 and then slides along the lower surface of the guide members 120 under the force of gravity as indicated by broken lines P2.

Subsequently, when reaching the leading edges of the guide members 120, the leading edge portion of the recording sheet is caused to contact the circumferential surface of the pickup roller 104 at the position beneath the horizontal line Lm passing through the center of rotation of the pickup roller 104, that is, at the position shifted from the horizontal line Lm toward the nip position N.

When the leading edge portion of the recording sheet contacts the circumferential surface of the pickup roller 104 at a position beneath the horizontal line Lm, shifted from the horizontal line Lm toward the nip position N, the recording sheet is drawn in the direction opposite the direction of the curl due to the torque in the rotational direction of the pickup roller 104 and accordingly is guided naturally to the nip position N as indicated by a solid line P3 shown in FIG. 6C.

Figure 8:
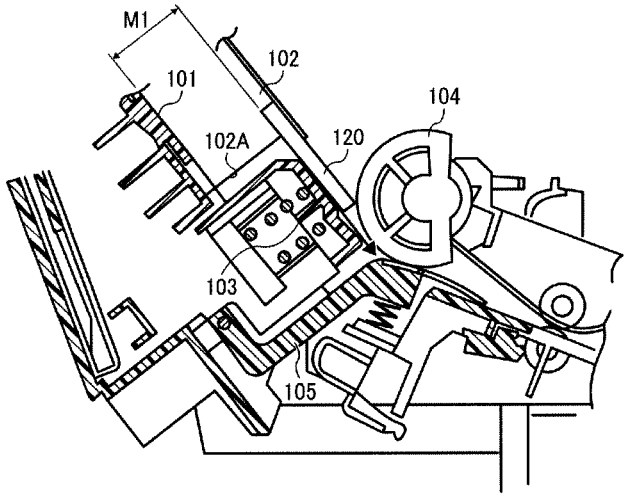
FIG. 8 illustrates a main part of the sheet feeder for picking up and conveying the recording sheet and corresponds to the state shown in FIG. 6C.

FIG. 8 illustrates a main part of the sheet feeder 100 for picking up and conveying the recording sheet and corresponds to the state shown in FIG. 6C. It is to be noted that reference character M1 shown in FIG. 8 represents the height of recording sheets stackable in the sheet feeder 100.

It is to be noted that, the length S by which the guide members 120 project forward from the leading edges 102A of the side fences 102 is preferably set to such an amount that the projecting portion does not cause sliding resistance between the moving recording sheet and the surface of the guide members 120 which the recording sheet is in contact with. Such setting can be attained by setting it in view of the sheet thickness that affects the degree of rigidness of the recording sheet.

As described above, in the present embodiment in which recording sheets are transported to the nip position N in the oblique feeding method using the force of gravity, the guide members 120 help the upwardly curling leading edge portion of the recording sheet to confirm the rotational direction of the pickup roller 104. Consequently, the leading edge portion of the recording sheet can be guided to the nip position N substantially automatically.

Thus, the recording sheet with its leading edge portion curling upward can be picked up and conveyed properly. Moreover, such proper sheet feeding can be attained with not by adding a dedicated component but using the existing side fences, and thus the cost does not increase. Additionally, it is not necessary to increase the distance between the elevation unit 103 and the pickup roller 104 in order to guide the curling leading edge portion of the recording sheet toward the nip position N with the rotational direction of the pickup roller 104. Therefore, the height M1 (shown in FIG. 8) of stackable recording sheets, that is, the number of sheets stackable in the sheet feeder 100, is not reduced.

Descriptions will be given below of variations of the main part of the present embodiment.

Figure 9A:
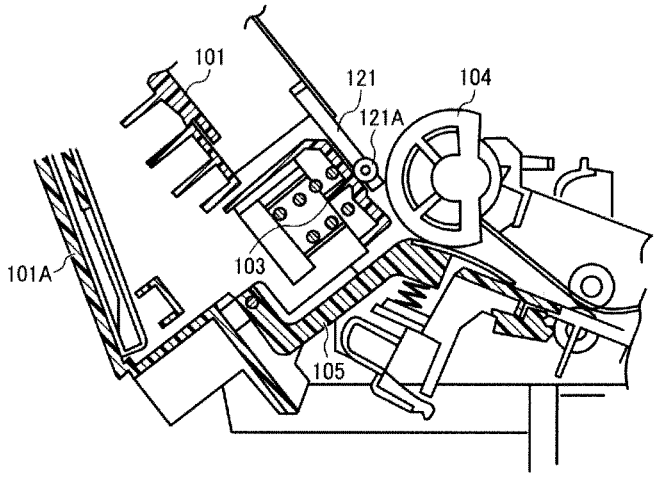
FIGS. 9A and 9B are schematic views that illustrate variations of the guide members.
Figure 9B:
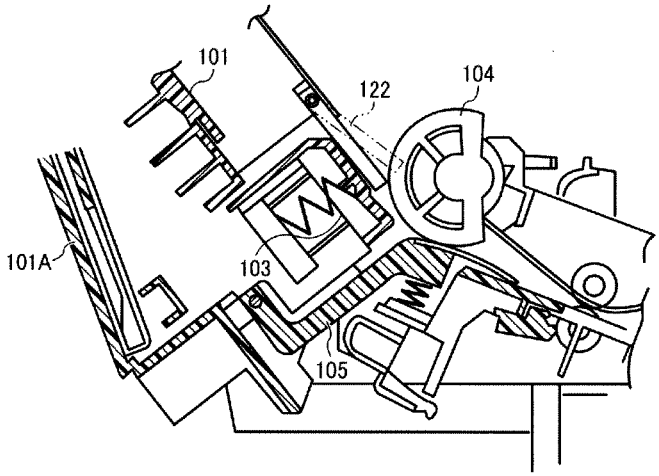

FIGS. 9A and 9B are schematic views that illustrate variations of the guide members. The configuration shown in FIG. 9A uses a guide member 121 including a roller 121A that is disposed adjacent to the leading edge portion of the recording sheet so that the recording sheet can contact the roller 121A. This configuration can reduce sliding resistance of the recording sheet.

By contrast, the configuration shown in FIG. 9B uses a guide member 122 that is hinged with its leading side swingable. With this configuration, the swingable portion of the guide member 122 can swing in accordance with the thickness of the recording sheet, pushed by the recording sheet. Therefore, the contact pressure between the guide member 122 and the recording sheet can be reduced while allowing the guide member 122 to contact the recording sheet. Consequently, this configuration can reduce sliding resistance of the recording sheet as well.

Figure 10:
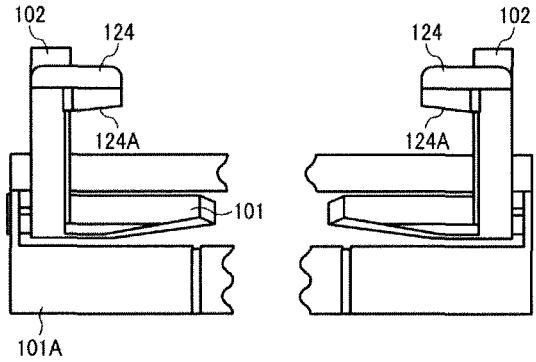
FIG. 10 illustrates another variation of the guide member for reducing the sliding resistance of the recording sheet, viewed from the leading side in the sheet feeding direction.

FIG. 10 illustrates another variation of the guide member for reducing the sliding resistance of the recording sheet, viewed from the leading side in the sheet feeding direction.

Referring to FIG. 10, a guide member 124 includes a slant surface 124A on a lower side, that is, a contact surface with the recording sheet is slant.

When the contact surface which the recording sheet contacts is slant, the leading edge portion of the recording sheet contacts the guide members 124 only partly, and the sliding resistance of the recording sheet can be smaller compared with a case in which the greater area of the upper surface of the recording sheet contacts the guide member.

Thus, the above-described variations can alleviate the sliding resistance between the recording sheet and the guide member in addition to guide the leading edge of the recording sheet toward the nip position N, and thus the timing at which the sheet is picked up and conveyed is not affected adversely.

Figure 11:
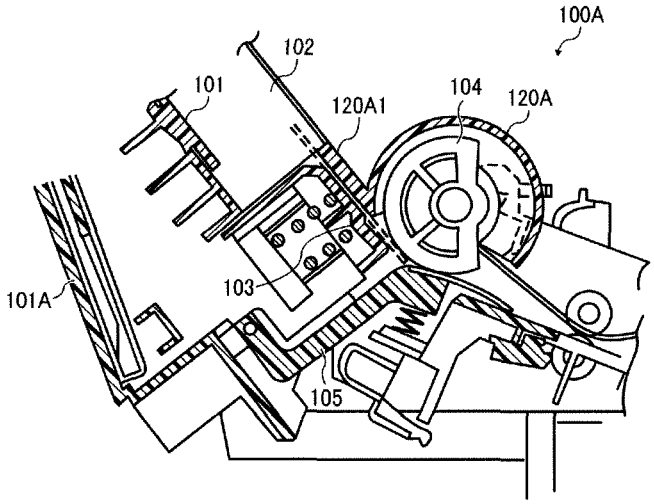
FIG. 11 illustrates a sheet feeder according to another embodiment in which a guide member is provided not on side fences but on a pickup roller.

FIG. 11 illustrates a sheet feeder 100A according to another embodiment in which the guide member is provided not on the side fences but on the pickup roller 104.

Referring to FIG. 11, a guide unit 120A is configured like a housing that extends in the axial direction of the pickup roller 104 and covers the pickup roller 104 partly in its circumferential direction with a portion of the pickup roller 104 facing the separation pad 105 exposed. A shaft of the pickup roller 104 supports walls of the guide unit 120A on both sides in the axial direction of the pickup roller 104. The guide unit 120A includes a guide member 102A1 that is configured according to the theory described above, with reference to FIG. 6, and disposed in a portion facing the elevation unit 103 in the rotational direction of the pickup roller 104.

The number and position of the guide member 120A1 in the axial direction of the pickup roller 104 is not limited to the above-described configuration in which two guide members are disposed on both end portions in the axial direction as long as the position is adjacent to the outer circumferential surface of the pickup roller 104. For example, a single or multiple guide members 120A1 may be provided partly or entirely in the axial direction of the pickup roller 104. That is, a single guide member 120A1 may be provided only in a center portion, multiple guide members 120A1 may be provided at positions including the center portion as well as the end portions, or a single guide member 120A1 extending in the axial direction may be provided.

As described above, the sheet feeder according to the above-described embodiments includes the guide member for directing the leading edge portion of the recording sheet downstream in the rotational direction of the feeding member, such as a pickup roller, in order to guide the leading edge portion of the recording sheet to the clamped position. Therefore, even when curling upward along the sheet feeding direction, the leading edge portion of the recording sheet can be guided to the nip position (i.e., clamped position) reliably and then is clamped between the feeding member and the elevation unit.

In particular, the leading edge portion of the guide member in the sheet feeding direction is disposed such a position that the leading edge portion of the recording sheet can be guided easily to the nip position as the feeding member rotates. That is, the leading edge portion of the guide member is disposed at such a position that the curling leading edge portion of the recording sheet can be easily drawn in the direction opposite the direction of the curl due to the rotational force of the feeding roller. Accordingly, the recording sheet with its leading edge portion curling in the opposite direction of the rotational direction of the feeding roller can be guided to the nip position reliably.

Numerous additional modifications and variations are possible in light of the above teachings. It is therefore to be understood that, within the scope of the appended claims, the disclosure of this patent specification may be practiced otherwise than as specifically described herein.

What is claimed is:

1. A sheet feeder comprising:

a stacker that accommodates multiple sheets of recording media;

an elevation unit disposed in a downstream portion of the stacker in a sheet feeding direction and which ascends to lift a leading edge portion of the sheet in the sheet feeding direction;

a rotary feeding member disposed facing the elevation unit and forming a nip in which the leading edge portion of the sheet is clamped together with the elevation unit when the elevation unit ascends; and a guide unit having a leading edge in the sheet feeding direction and disposed adjacent to an outer circumference of the feeding member, facing an upper side of the sheet, the leading edge of the guide unit guiding the leading edge portion of the sheet toward a position where the nip between the feeding member and the elevation unit is to be formed, wherein the leading edge of the guide unit in the sheet feeding direction projects beyond a leading edge of the stacker downstream in the sheet feeding direction.

2. The sheet feeder according to claim 1, wherein the nip between the feeding member and the elevation unit is positioned substantially on a normal line of the feeding member, and the leading edge of the guide unit in the sheet feeding direction is positioned upstream from the position where the nip between the feeding member and the elevation unit is to be formed in the sheet feeding direction, and is shifted to the position where the nip between the feeding member and the elevation unit is to be formed from a horizontal line passing through a center of rotation of the feeding member in a rotational direction of the feeding member.

3. The sheet feeder according to claim 2, wherein a trailing edge of the guide unit in the sheet feeding direction is positioned above the horizontal line passing through the center of rotation of the feeding member.

4. The sheet feeder according to claim 1, wherein the leading edge of the guide unit in the sheet feeding direction is positioned upstream from the position where the nip between the feeding member and the elevation unit is to be formed in the sheet feeding direction, and in a third quadrant of a coordinate plane centered on a center of rotation of the feeding member, the leading edge of the guide unit is shifted toward a vertical line passing through a coordinate center from a horizontal line passing through the coordinate center.

5. The sheet feeder according to claim 1, further comprising a pair of side fences disposed on both sides of the sheet feeder in an axial direction of the feeding member, wherein the guide unit is provided in an upper portion of the side fence on a leading side in the sheet feeding direction, the leading edge of the guide unit projects toward the feeding member from a leading edge of each side fence in the sheet feeding direction, the leading edge of the guide unit in the sheet feeding direction is positioned upstream from the position where the nip between the feeding member and the elevation unit is to be formed in a rotational direction of the feeding member, and in a third quadrant of a coordinate plane centered on a center of rotation of the feeding member, the leading edge of the guide unit is shifted from a horizontal line passing through the coordinate center toward a vertical line passing through a coordinate center as well as toward the position where the nip between the feeding member and the elevation unit is to be formed.

6. The sheet feeder according to claim 1, wherein a lower surface of the guide unit is inclined in the sheet feeding direction, with respect to a horizontal line.

7. The sheet feeder according to claim 1, wherein the guide unit guides the leading edge portion of the sheet toward the position where the nip between the feeding member and the elevation unit is to be formed, by directing the leading edge portion of the sheet downstream in a rotational direction of the feeding member.

8. The sheet feeder according to claim 1, wherein a gap between an upper surface of the elevation unit and a lower surface of the leading edge of the guide unit has a predetermined size that allows only a single recording sheet to pass through the gap smoothly.

9. The sheet feeder according to claim 1, wherein the guide unit includes a roller that is disposed adjacent to the leading edge of the guide unit such that the recording sheet contacts the roller.

10. The sheet feeder according to claim 1, wherein the guide unit includes a hinge around which a leading edge portion of the guide unit is swung by an amount based on a thickness of the sheet.

11. The sheet feeder according to claim 1, wherein the guide unit includes a slant surface on a lower side, the slant surface causing the leading edge portion of the recording sheet to contact the guide unit only partly.

12. The sheet feeder according to claim 1, wherein the guide unit is configured to cause the leading edge portion of the sheet to move past the leading edge of the guide unit toward the position where the nip between the feeding member and the elevation unit is to be formed, when the sheet is fed in the sheet feeding direction.

13. The sheet feeder according to claim 1, wherein when the leading edge portion of the sheet contacts the guide unit, the leading edge portion of the sheet slides along the lower surface of the guide unit under gravity toward the leading edge of the guide unit in the sheet feeding direction.

14. A sheet feeder comprising:

a stacker that accommodates multiple sheets of recording media;

an elevation unit disposed in a downstream portion of the stacker in a sheet feeding direction and which ascends to lift a leading edge portion of the sheet in the sheet feeding direction;

a rotary feeding member disposed facing the elevation unit and forming a nip in which the leading edge portion of the sheet is clamped together with the elevation unit when the elevation unit ascends; and a guide unit having a leading edge in the sheet feeding direction and disposed adjacent to an outer circumference of the feeding member, facing an upper side of the sheet, the leading edge of the guide unit guiding the leading edge portion of the sheet toward a position where the nip between the feeding member and the elevation unit is to be formed, wherein the leading edge of the guide unit in the sheet feeding direction projects beyond a leading edge of the stacker downstream in the sheet feeding direction, and wherein the stacker is inclined in the sheet feeding direction, and the feeding member transports the sheet conveyed thereto by gravity toward the position where the nip between the feeding member and the elevation unit is to be formed.

15. An image forming apparatus, comprising:

an image forming unit to form an image on a sheet of recording media; and a sheet feeder, the sheet feeder comprising:

a stacker that accommodates multiple sheets of recording media;

an elevation unit disposed in a downstream portion of the stacker in a sheet feeding direction in which the sheet is transported from the stacker and which ascends to lift a leading edge portion of the sheet in the sheet feeding direction;

a rotary feeding member disposed facing the elevation unit and forming a nip in which the leading edge portion of the sheet is clamped together with the elevation unit when the elevation unit ascends; and a guide unit having a leading edge in the sheet feeding direction and disposed adjacent to an outer circumference of the feeding member, facing an upper side of the sheet, the leading edge of the guide unit guiding the leading edge portion of the sheet toward a position where the nip between the feeding member and the elevation unit is to be formed, wherein the leading edge of the guide unit in the sheet feeding direction projects beyond a leading edge of the stacker downstream in the sheet feeding direction.

16. The image forming apparatus according to claim 15, wherein the nip between the feeding member and the elevation unit is positioned substantially on a normal line of the feeding member, and the leading edge of the guide unit in the sheet feeding direction is positioned upstream from the position where the nip between the feeding member and the elevation unit is to be formed in the sheet feeding direction, and is shifted to the position where the nip between the feeding member and the elevation unit is to be formed from a horizontal line passing through a center of rotation of the feeding member in a rotational direction of the feeding member.

17. The image forming apparatus according to claim 16, wherein a trailing edge of the guide unit in the sheet feeding direction is positioned above the horizontal line passing through the center of rotation of the feeding member.

18. The image forming apparatus according to claim 15, wherein the leading edge of the guide unit in the sheet feeding direction is positioned upstream from the position where the nip between the feeding member and the elevation unit is to be formed in the sheet feeding direction, and in a third quadrant of a coordinate plane centered on a center of rotation of the feeding member, the leading edge of the guide unit is shifted toward a vertical line passing through a coordinate center from a horizontal line passing through the coordinate center.

* * * * *